United States Patent [19]

Surowiecki

[11] Patent Number: 4,674,368

[45] Date of Patent: Jun. 23, 1987

[54] RATCHET MECHANISM FOR HYDRAULIC WRENCH

[75] Inventor: Mark W. Surowiecki, Meriden, Conn.

[73] Assignee: Raymond Engineering Inc., Middletown, Conn.

[21] Appl. No.: 745,404

[22] Filed: Jun. 14, 1985

[51] Int. Cl.[4] ..... B25B 13/46

[52] U.S. Cl. ..... 81/57.39; 81/59.1

[58] Field of Search ..... 81/57.39, 59.1; 192/42, 192/45, 53 E, 53 F

[56] References Cited

U.S. PATENT DOCUMENTS 2,651,395 9/1953 Syrovy et al. ..... 192/53 F X 3,745,858 7/1973 Biach ..... 81/57.39

*Primary Examiner*—Frederick R. Schmidt

*Assistant Examiner*—Maurina Rachuba

*Attorney, Agent, or Firm*—Fishman & Dionne

[57] ABSTRACT

An improved ratchet construction for a powered wrench of the type which includes an oscillating power unit adapted to provide torque to a socket assembly during each forward stroke, and a ratchet mechanism which permits the drive mechanism to return to its initial position at the completion of each stroke without applying a reverse torque to the select assembly is presented. The improved ratchet construction acts to synchronize the coupling elements (i.e., the pins) so that the correct number of pins will (1) be seated in their recesses at the same time; and (2) the pins will wait until a "throat" is properly opened before dropping into their respective recesses (thus preventing a pin from partially seating and making a "click" sound which might signal the operator to apply the power stroke). In this way the correct number of pins will be completely seated in its recess when the operator attempts the power stroke.

30 Claims, 4 Drawing Figures

RATCHET MECHANISM FOR HYDRAULIC WRENCH

BACKGROUND OF THE INVENTION

This invention relates generally to a torquing device. More particularly, this invention relates to an improved ratchet mechanism for a powered wrench.

The wrench of the type to which the present invention applies includes an oscillating power unit adapted to provide torque to a socket assembly during each forward stroke, and a ratchet mechanism which permits the drive mechanism to return to its initial position at the completion of each stroke without applying a reverse torque to the socket assembly. The wrench is designed to distribute the load of the power source evenly to the socket by causing two or more coupling elements of the ratchet to assume an equal share of the applied load. The wrench comprises a socket member and a drive unit having complimentary recess formed on the adjacent faces thereof. Coupling elements, which may take the form of cylindrical pins, are located in the recesses, and a garter spring or "O" ring or similar element is disposed in the unit and serve to urge the coupling pins toward the recess surfaces of the socket unit. Each recess of the driving unit, its associated recess on the socket member and the associated coupling member defines a coupling and/or ratchet unit. The combined coupled and/or ratchet unit form the ratchet assembly for the wrench. During operation, the driving unit is moved in one direction, two or more of the pins are seated in recesses in the socket member and are trapped between surfaces of the recesses of the drive unit and the socket member to couple the socket member to the drive unit and thereby rotate the socket member. When the drive unit is rotated in the opposite direction, the pins are moved out of driving engagement between the drive unit and the socket member, thereby uncoupling the socket and drive unit so as to permit the free return of the drive unit without causing a corresponding rotation of the socket member. During this return stroke, the pins are carried with the drive unit and move from one recess site toward the next recess site where two or more pins are again seated in recesses of the socket member in anticipation of another power stroke.

Hydraulically powered wrenches of the general type discussed above are marketed by the Powerdyne Division of Raymond Engineering Inc., and an early version of one type of such wrench is shown in U.S. Pat. No. 3,745,858, particularly FIG. 6 thereof. U.S. Pat. No. 3,745,858 is owned by the assignee of this invention, and it is incorporated herein by reference in its entirety.

While suitable for it's intended purposes, the wrenches described above, and particularly the ratchet assembly thereof, suffer from one particular deficiency or drawback, which is that the pins may not move properly in synchronism between recess sites of the socket member. The problem does not occur if the pins are always driven only through the trailing edge of the drive unit recess, because movement of the pins is then always synchronized. The problem that arises, is that a pin may move in advance of the trailing edge of the drive unit recess. For example, due to foreign matter, e.g., dirt, or flaking of material lodging between the pins and the garter spring or due to lack of proper lubrication, or because the spring is too tight, the spring may drive a pin ahead of the trailing edge of the drive unit recess. As a result, a pin may advance and prematurely drop into the next recess or lodge at a corner of a recess. Still another problem with the improper advancement of pins is that a pin may enter a recess in a cocked position; or only one pin will seat in a recess. Consequently, there is uneven loading during the power stroke, and some pins may crack or imbed into the corner of the recess.

In order to achieve proper torque output in the smallest size wrench (6 pins), at least two pins must be properly seated in the rachet during the power stroke. In larger wrenches, between two and twelve pins must be properly seated, depending on the size of the wrench, to achieve proper torque output and lead distribution. If fewer pins than are necessary for proper torque output are seated in the recesses, serious problems are encountered. The pins that are properly seated will be overloaded and may be damaged, thereby necessitating expensive replacement and repair. Also the pins which have not been seated, i.e., which have been hung up and have not properly advanced, may also be damaged.

During the reverse ratcheting stroke, the operator of a wrench of the type under discussion, will hear a "click" sound indicating that the pins have been seated in the recess and that the power stroke may be applied. Unfortunately, often that "click" sound is only one pin dropping into a recess, or less than the desired number of pins. If this condition occurs, the problems discussed above will result.

SUMMARY OF THE INVENTION

The above discussed and other problems and deficiencies of the prior art are overcome or alleviated by the ratchet mechanism for a hydraulic wrench of the present invention. In accordance with the present invention, a novel ratchet construction is provided which acts to synchronize the coupling elements (i.e., the pins) so that the correct number of pins will (1) be seated in their recesses at the same time; and (2) the pins will wait until a "throat" is properly opened before dropping into their respective recesses (thus preventing a pin from partially seating and making a "click" sound which might signal the operator to apply the power stroke). In this way the correct number of pins will be completely seated in its recess when the operator attempts the power stroke.

In accordance with the present invention, small detents or lead-in recesses are provided on the outer surface or face of the socket element (which functions as the inner ratchet member) of the wrench. A detent is provided at the leading edge of each recess and will act to interrupt and synchronize the advancement of the pins during the reverse ratcheting stroke until the shoulder on the outer ratchet member positively seats all pins at the same time. The detent at each recess site makes each pin wait for a positive seating action before the pin moves into the recess. In a preferred embodiment, the center line of the detent is one half the radius of a pin from the leading edge of the recess, and the corner of the detent is rounded.

The above discussed and other advantages of the present invention will be apparent to and understood by those skilled in the art from the following detailed description and drawings.

BRIEF DESCRIPTION OF THE DRAWINGS:

Referring now to the drawings, wherein like elements are numbered alike in the several figures.

Figure 3:
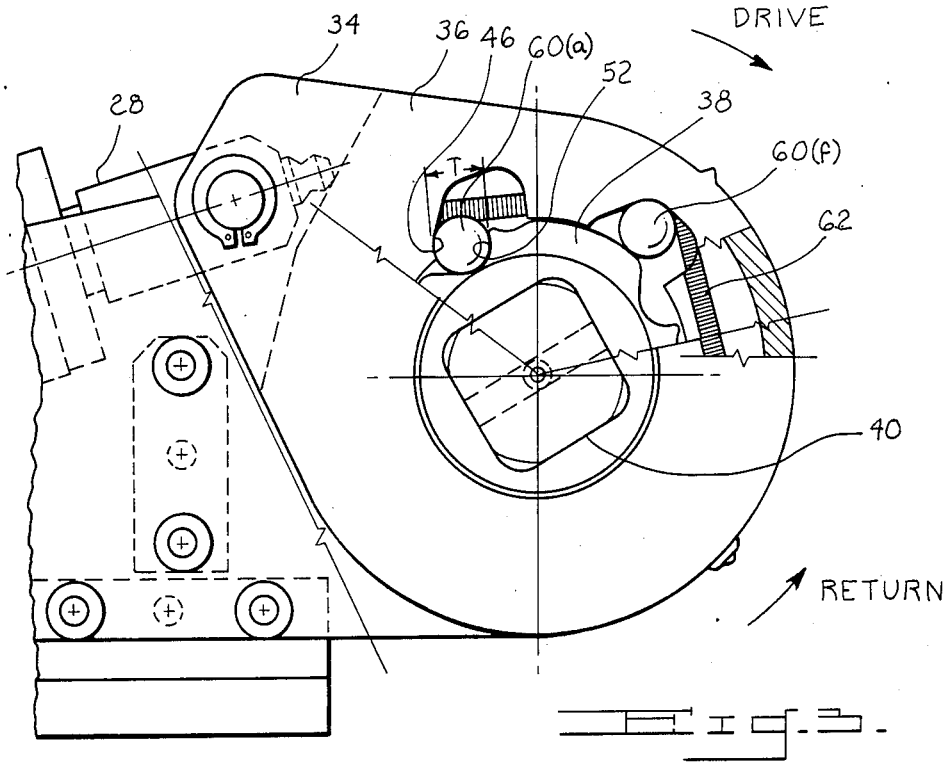
FIG. 3 is a side elevation view, partly in section, of an enlarged detail of FIG. 4 showing the assembled drive and ratchet mechanism of the present invention.
Figure 4:
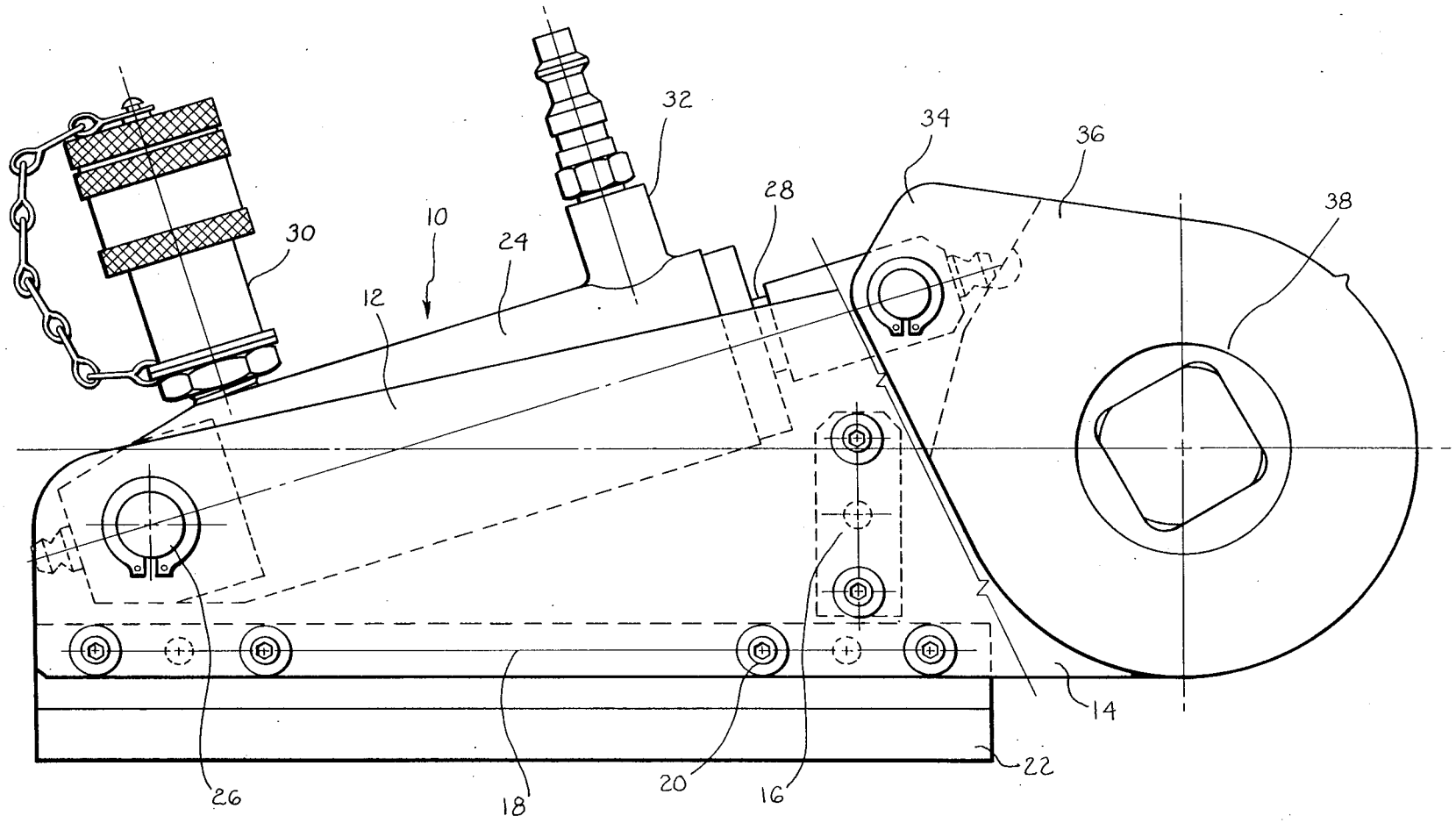
FIG. 4 is a side elevation view of the hydraulic wrench of the present invention.

DESCRIPTION OF THE PREFERRED EMBODIMENT:

Referring first to FIGS. 3 and 4, the hydraulic wrench of the present invention, indicated generally at 10, has a frame consisting of upper plate member 12 and lower plate member 14 which are held together in spaced apart relationship by spacer blocks 16 and 18 which are secured in place between the plates by fasteners 20. Spacer block 18 also has a projecting portion 22 which serves as a reaction surface for the wrench. The hydraulic cylinder 24 is housed between plates 12 and 14 and is pivotally connected to each of the plates by a pivot connection 26. A piston (not shown) is housed in hydraulic cylinder 24, and a piston rod 28 extends from the forward end of cylinder 24. Supply lines 30 and 32 are connected to opposite ends of cylinder 24 to deliver pressurized fluid, such as hydraulic or pneumatic fluid, to opposite ends of the piston to operate the unit. The forward end of the piston rod is connected via a clevis 34 to the end of the driving unit lever arm 36. In the configuration shown in the drawings, the driving direction, i.e., for delivery of torque, is in a clockwise direction, and the return ratcheting direction is counterclockwise.

A generally circular opening extends through the driving unit lever arm 34, and aligned cut-outs are provided in the top and bottom plates 12 and 14. A socket member 38 is positioned in this central opening in drive unit lever arm 36 and is held in place by snap rings (not shown). Socket unit 38 has a square drive bar 40 extending therefrom to engage suitable drive elements to be mounted on the end thereof.

Figure 1:
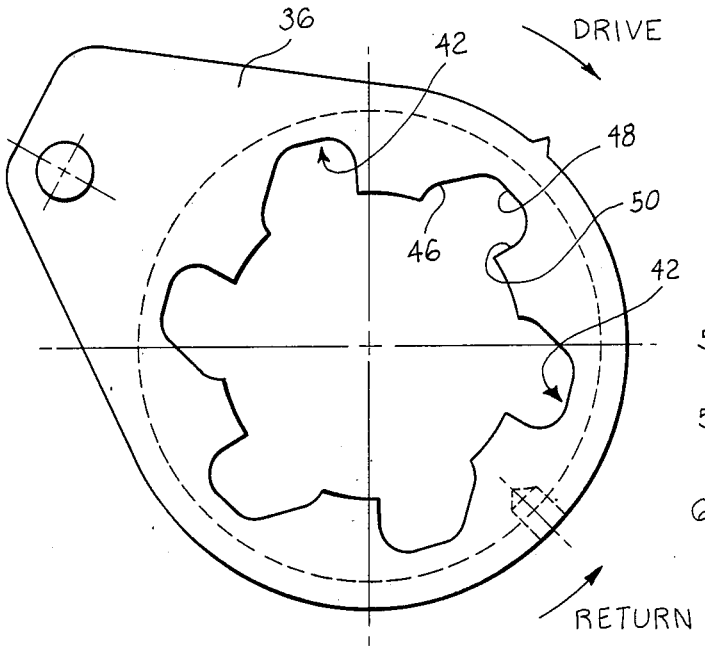
FIG. 1 is a bottom plan view of the drive element for the wrench of the present invention.
Figure 2:
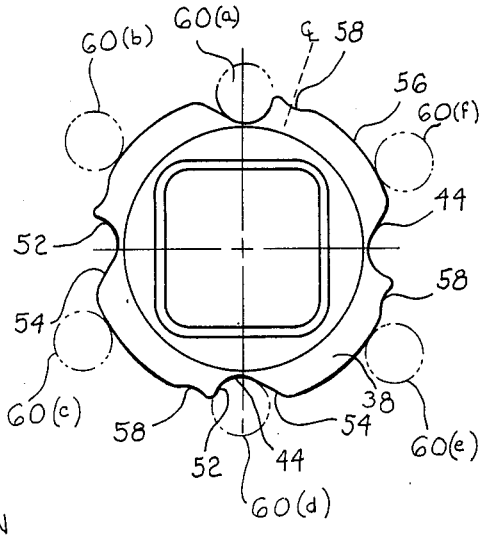
FIG. 2 is a bottom plan view of the socket element for the improved wrench of the present invention.

As best seen in FIGS. 1 and 2, drive unit lever arm 36 has a series of contoured recesses 42, and socket unit 38 also has a series of contoured recesses 44. In the embodiment of FIGS. 1 and 2, lever arm has six recesses, and socket unit 38 has four recesses. Each of the recesses 42 in drive unit lever arm 36 has a torque transmission or torque drive section 46, a free section 48, and a reset section 50. Each of the recesses 44 in socket unit 38 has a drive section 52 and a reset ramp section 54. Between the reset ramp section 54 of the recess 44 and the drive section 52 of the next recess, there is a generally constant radius section 56 which leads into a detent or lead-in recess 58. The structure and function of detent or lead-in recess 58 constitutes the inventive feature of the present invention, all of the other structures shown and described herein being known in the wrenches presently being sold by Raymond Engineering Inc.

Generally cylindrical coupling pins 60(*a*), 60(*b*), etc. serve to couple the drive unit lever arm 36 to socket unit 38 for torque transmission when fluid is delivered to hydraulic cylinder 24 to drive lever arm 34 in the clockwise direction. As shown in FIG. 3, pin 60(*a*) is shown engaged between a drive section 46 of a lever arm recess 42 and a drive section 52 of a socket recess 44. This is the torque transmission position, and when two pins (i.e. pin 60(*a*) and the pin 60(*d*) 180° spaced therefrom) are in this position, clockwise movement of lever arm 36 will result in torque transmission and clockwise rotation of socket unit 38. In FIG. 2, the pins 60(*a*) and 60(*d*) are similarly shown in phantom in the driving position and pins 60(*b*) and 60(*e*) are shown just upstream of detents 58 waiting to be moved into the recesses 44 for torque coupling. In the embodiment shown in FIGS. 1, 2 and 3, a total of six pins are employed forming 3 diametrically opposed sets. A first set 60(*a*) and 60(*d*) will be seated in recessed 44 for torque coupling, a second set 60(*b*) and 60(*e*) will be on surface 56 upstream of or in detents 58, and a third set 60(*c*) and 60(*f*) will be on surface 56 near the exit from recesses 44. A garter spring 62 extends around the socket unit and engages all of the pins 60 to constantly urge the pins toward the center of the socket unit.

After a drive cycle has been completed, the pressurization across the piston in hydraulic cylinder 24 is reversed to initiate a return stroke. On the return stroke, each reset section 50 comes into engagement with one of the pins. The pins 60(*a*) and 60(*d*) in the sockets recesses 44, are each rolled up the reset ramp 44 and onto the constant radius section 56. The pins 60(*b*) and 60(*e*) will be moved into the recesses 44; and the pins 60(*c*) and 60(*f*) will be moved along surface 56 to a position just upstream of or into the detents. The depth of free section 48 of each recess 42 is greater than the diameter of the pin, so that the pin is free to travel along constant radius section 56 as it is moved counterclockwise by reset section 50, the pin being held against constant radius section 56 by the action of garter spring 62. Thus, on the reset stroke, the pins 60 are travelling in a counterclockwise direction about the center of the socket unit. Before pins 60(*b*) and 60(*e*) reach the next succeeding recess 44 in the counterclockwise direction, each of these pins will enter into the detent 58 which is immediately upstream of the drive section 52 of the next recess 44. The detent tends to interrupt and synchronize the movement of each pin 60 as it enters the detent. Thus, if, on the return stroke, a pin has moved ahead of the other pin, the action of the detent will correct any uneven movement of the pins. Each of the pins moving in the reset direction will enter its detent and will be moved out of the detent only by the action of a reset section 50 engaging the pin and positively moving the pin out of detent and into the next recess 44 in the counterclockwise direction in synchronism with all other pins which are scheduled to move into a recess for torque coupling in that cycle of operation of the wrench. When the pins are thusly moved into the recesses 44, the unit is then ready for another power stroke in the clockwise direction.

In the preferred configuration, the center line (C/L, see FIG. 2) of a detent will be spaced from the beginning of the drive section 52 of its adjacent recess 44 by a distance equal to one half the radius of the pin 60. Also, in the preferred configuration, the transition zone between detent 58 and a recess 44 will be rounded. It should also be noted (see FIG. 3) that a pin 60 cannot enter into a recess 44 during a return stroke until the throat T between drive section 46 and drive section 52 becomes greater than the diameter of the pin; and said throat becomes greater than the diameter of the pin; only after reset section 50 is in contact with the pin to be seated. This provides a further assurance that all of the pins will be synchronized and will move out of the detents and into the recess 44 in unison.

The unit described above with two active torque coupling pins and four "floating" pins is conceptually similar to the embodiment of FIG. 6 of U.S. Pat. No. 3,745,858 which has active and floating pins. However, it will be understood that the number of pins will depend on the size and torque rating of the pins. It will also be understood that the number of active coupling pins (including all pins), is a matter of design choice depending on the relative spacing of parts and the stroke of the unit.

From the foregoing, it will be seen and understood that the present invention results in synchronization of the load transmission pins so that the pins are all properly seated in their respective recesses on the return stroke in preparation for the next succeeding drive stroke. Thus, the present invention overcomes the problems of the prior art and results in a wrench that is highly reliable and can take full advantage, i.e., operate at maximum rating, of the safety features of being a fully enclosed ratchet configuration.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In a torquing device comprising a frame member, a reciprocating power source mounted on said frame member, a lever arm rotatably mounted on said frame member and coupled to said power source, surfaces of said lever arm defining a generally circular opening extending through said lever arm, said lever arm being formed with a plurality of lever arm recesses, a cylindrical socket member having an outer surface, said socket member being disposed within said lever arm circular opening and having surfaces defining a plurality of socket member recesses positioned to generally face toward said lever arm recesses, a plurality of force transmitting coupling elements for positioning in the recesses of the lever arm and socket member, said coupling elements providing a force transmitting connection between said lever arm and said socket member at a first position and said connection being interrupted at a second position, and means for urging selected coupling elements into said first position when a force is applied to said lever arm in one direction and means for urging selected coupling elements into said second position when a force is applied to said lever arm in the opposite direction, the improvement comprising:

means for synchronizing said force transmitting coupling elements whereby selected coupling elements will simultaneously be seated into said socket member recesses to couple said lever arm to said socket member when said selected coupling elements are urged into said first position; and wherein said coupling elements synchronizing means comprises a plurality of detent means on said outer surface of said socket member.

2. The device of claim 1 wherein said socket member recesses include a leading edge and a trailing edge and wherein:

each of said detent means is disposed adjacent said leading edge of a respective one of each of said socket member recesses.

3. The device of claim 2 wherein:

said coupling elements include cylindrical pins; and a center line extending from each of said detent means will be spaced from said leading edge of a respective adjacent socket member recess a distance of about one half ($\frac{1}{2}$) the radius of said coupling element.

4. The device of claim 2 wherein the portion of said detent means which is adjacent said leading edge of said adjacent socket member recess is rounded.

5. The device of claim 3 wherein the portion of said detent means which is adjacent said leading edge of said adjacent socket member recess is rounded.

6. The device of claim 1 wherein:

said coupling elements include cylindrical pins; and each of said lever arm recesses include a first coupling element drive section and each of said socket member recesses include a second coupling element drive section, the distance between said first and second drive sections defining a throat; and wherein a coupling element is precluded from seating in a socket member recess until said throat becomes greater than the diameter of the coupling element to be seated.

7. The device of claim 6 wherein:

each of said lever arm recesses include a reset section, said reset section being oppositely disposed from said drive section; and wherein said throat becomes greater than the diameter of said coupling element only after said reset section contacts the coupling element to be seated.

8. In a torquing device comprising:

a frame member;

a reciprocating power source mounted on said frame member;

a lever arm rotatably mounted on said frame member and coupled to said power source, surfaces of said lever arm defining a generally circular opening extending through said lever arm, said lever arm being formed with a plurality of lever arm recesses;

a cylindrical socket member having an outer surface, said socket member being disposed within said lever arm circular opening and having surfaces defining a plurality of recesses positioned to generally face toward said lever arm recesses;

a plurality of force transmitting coupling elements for positioning in the recesses of the lever arm and socket member, said coupling elements providing a force transmitting connection between said lever arm and said socket member at a first position and said connection being interrupted at a second position;

means for urging selected coupling elements into said first position when a force is applied to said lever arm in one direction;

means for urging selected coupling elements into said second position when a force is applied to said lever arm in the opposite direction;

means for synchronizing said force transmitting coupling elements whereby selected coupling elements will simultaneously be seated into said socket member when said selected coupling elements are urged into said first position; and wherein said coupling elements synchronizing means comprises a plurality of detent means on said outer surface of said socket member.

9. The device of claim 8 wherein said socket member recesses include a leading edge and a trailing edge and wherein:

each of said detent means is disposed adjacent said leading edge of a respective one of each of said socket member recesses.

10. The device of claim 9 wherein:

said coupling elements include cylindrical pins; and a center line extending from each of said detent means will be spaced from said leading edge of a respective adjacent socket member recess a distance of about one half (½) the radius of said coupling element.

11. The device of claim 9 wherein the portion of said detent means which is adjacent said leading edge of said adjacent socket member recess is rounded.

12. The device of claim 10 wherein the portion of said detent means which is adjacent said leading edge of said adjacent socket member recess is rounded.

13. The device of claim 8 wherein:

said coupling elements include cylindrical pins; and each of said lever arm recesses include a first coupling element drive section and each of said socket member recesses include a second coupling element drive section, the distance between said first and second drive sections defining a throat; and wherein a coupling element is precluded from seating in a socket member recess until said throat becomes greater than the diameter of the coupling element to be seated.

14. The device of claim 13 wherein:

each of said lever arm recesses include a reset section, said reset section being oppositely disposed from said drive section; and wherein said throat becomes greater than the diameter of said coupling element only after said reset section contacts the coupling element to be seated.

15. In a torquing device comprising a frame member, a reciprocating power source mounted on said frame member, a lever arm rotatably mounted on said frame member and coupled to said power source, a generally circular opening extending through said lever arm, a plurality of first recesses around and opening toward said generally circular opening, a cylindrical output member disposed within said generally circular opening toward said first recesses, a plurality of torque transmitting coupling elements between said output member and said lever arm, said coupling elements being capable of asynchronous movement, and said coupling elements providing a torque transmitting coupling between said lever arm and said output member in a first position and said coupling being disengaged at a second position, means for urging selected coupling elements into said first position when a force is applied to said lever arm in one direction and means for urging selected coupling elements into said second position when a force is applied to said lever arm in the opposite direction, the improvement comprising:

means for synchronizing said torque transmitting coupling elements whereby selected coupling elements capable of asynchronous movement will be synchronized to simultaneously seat in recesses in said output member when said selected coupling elements are urged to said first position.

16. The apparatus of claim 15 wherein said output member has an outer surface and wherein said synchronizing means comprises:

a plurality of detent means on the outer surface of said output member.

17. The apparatus of claim 16 wherein said output member recesses include a leading edge and a trailing edge and wherein:

each of said detent means is disposed adjacent said leading edge of each of said output member recesses.

18. The apparatus of claim 17 wherein:

said coupling elements include cylindrical pins; and a center line extending from each of said detent means will be spaced from said leading edge of a respective adjacent output member recess a distance of about one half (½) the radius of said coupling element.

19. The apparatus of claim 17 wherein the portion of said detent means which is adjacent said leading edge of said adjacent output member recess is rounded.

20. The apparatus of claim 18 wherein the portion of said detent means which is adjacent said leading edge of said adjacent output member recess is rounded.

21. The apparatus of claim 15 wherein:

said coupling elements include cylindrical pins; and each of said lever arm recesses include a first coupling element drive section and each of said output member recesses include a second coupling element drive section, the distance between said first and second drive sections defining a throat; and a coupling element is precluded from seating in a output member recess until said throat becomes greater than the diameter of the coupling element to be seated.

22. The apparatus of claim 21 wherein:

each of said lever arm recesses include a reset section, said reset section being oppositely disposed from said drive section; and wherein said throat becomes greater than the diameter of said coupling element only after said reset section contacts the coupling element to be seated.

23. A torquing device comprising:

a frame member;

a reciprocating power source mounted on said frame member;

a lever arm rotatably mounted on said frame member and coupled to said power source, said lever arm having a circular opening extending through said lever arm, and a plurality of axially extending first recesses around and opening toward said generally circular opening;

a cylindrical output member disposed within said generally circular opening of said lever arm and having a plurality of second recesses opening toward said first recesses;

a plurality of torque transmitting coupling elements between said output member and said lever arm, said coupling elements being capable of asynchronous movement, and said coupling elements providing a torque transmitting coupling between said lever arm and said output member in a first position and said coupling being disengaged at a second position;

means for urging selected coupling elements into said first position when a force is applied to said lever arm in one direction;

means for urging selected coupling elements into said second position when a force is applied to said lever arm in the opposite direction; and means for synchronizing said torque transmitting coupling elements whereby selected coupling elements capable of asysynchronous movement will be synchronized to simultaneously seat in recesses in said output member when said selected coupling elements are urged to said first position.

24. The apparatus of claim 23 wherein said output member has an outer surface and wherein said coupling elements synchronizing means comprises:

a plurality of detent means on the outer surface of said output member.

25. The apparatus of claim 24 wherein said output member recesses include a leading edge and a trailing edge and wherein:

each of said detent means is disposed adjacent said leading edge of each of said output member recesses.

26. The apparatus of claim 25 wherein:

said coupling elements include cylindrical pins; and a center line extending from each of said detent means will be spaced from said leading edge of a respective adjacent output member recess in a distance of about one half ($\frac{1}{2}$) the radius of said coupling element.

27. The apparatus of claim 25 wherein the portion of said detent means which is adjacent said leading edge of said adjacent output member recess is rounded.

28. The apparatus of claim 26 wherein the portion of said detent means which is adjacent said leading edge of said adjacent output member recess is rounded.

29. The apparatus of claim 23 wherein:

said coupling elements include cylindrical pins; and each of said lever arm recesses include a first coupling element drive section and each of said output member recesses include a second coupling element drive section, the distance between said first and second drive sections defining a throat; and a coupling element is precluded from seating in a output member recess until said throat becomes greater than the diameter of the coupling element to be seated.

30. The apparatus of claim 29 wherein:

each of said lever arm recesses include a reset section, said reset section being oppositely disposed from said drive section; and wherein said throat becomes greater than the diameter of said coupling element only after said reset section contacts the coupling element to be seated.

* * * * *